US009537253B2

(12) United States Patent
Zhao

(10) Patent No.: US 9,537,253 B2
(45) Date of Patent: Jan. 3, 2017

(54) CONNECTION TERMINAL AND ELECTRICAL CONNECTOR

(71) Applicant: Tyco Electronics (Shanghai) Co. Ltd., Shanghai (CN)

(72) Inventor: Yuqiang Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/755,532

(22) Filed: Jun. 30, 2015

(65) Prior Publication Data

US 2015/0380851 A1 Dec. 31, 2015

(30) Foreign Application Priority Data

Jun. 30, 2014 (CN) ..... 2014 2 0355846

(51) Int. Cl.

| | |
|---|---|
| ***H01R 11/22*** | (2006.01) |
| ***H01R 13/58*** | (2006.01) |
| ***H01R 13/11*** | (2006.01) |
| *H01R 4/20* | (2006.01) |

(52) U.S. Cl.

CPC ..... *H01R 13/5837* (2013.01); *H01R 13/112* (2013.01); *H01R 4/206* (2013.01)

(58) Field of Classification Search

CPC ..... H01R 4/185; H01R 4/188; H01R 43/048; H01R 13/2442

USPC ..... 439/429, 434, 877, 882, 932, 857, 746, 439/748, 749

See application file for complete search history.

(56) References Cited

U.S. PATENT DOCUMENTS

| | | | | |
|---|---|---|---|---|
| 3,320,355 | A * | 5/1967 | Booker | H01R 4/203 174/84 R |
| 3,740,839 | A * | 6/1973 | Otte | C22F 1/006 29/447 |
| 3,790,920 | A * | 2/1974 | Wening | H01R 11/284 439/522 |
| 4,022,519 | A * | 5/1977 | Hill | H01R 4/01 411/909 |
| 4,053,196 | A * | 10/1977 | Dunaway | H01R 13/523 29/854 |
| 4,468,083 | A * | 8/1984 | Lee | H01R 4/20 29/862 |
| 4,497,527 | A * | 2/1985 | Cameron | H01R 4/01 439/161 |
| 4,634,201 | A * | 1/1987 | Kemka | H01R 4/01 439/161 |
| 5,618,187 | A * | 4/1997 | Goto | H01R 9/091 439/79 |
| 7,217,162 | B2 * | 5/2007 | Harada | H01R 13/113 439/857 |

(Continued)

FOREIGN PATENT DOCUMENTS

| | | |
|---|---|---|
| CN | 102801042 A | 11/2012 |
| CN | 202856090 U | 4/2013 |

OTHER PUBLICATIONS

Abstract of CN 102801042A, dated Nov. 28, 2012, 1 page.
Abstract of CN 202856090U, dated Apr. 3, 2013, 1 page.

*Primary Examiner* — Phuong Dinh
(74) *Attorney, Agent, or Firm* — Barley Snyder

(57) ABSTRACT

A connection terminal has a connector body having a mating end and an opposite cable receiving end; a pair of contact arms extending from the mating end; and a cable receiving member having an approximate cylindrical shape with a variable diameter, and extending from the cable receiving end.

18 Claims, 4 Drawing Sheets

(56) References Cited

U.S. PATENT DOCUMENTS

| | | | | |
|---|---|---|---|---|
| 7,500,868 | B2 * | 3/2009 | Holland | H01R 4/2412<br>439/427 |
| 8,021,184 | B1 * | 9/2011 | Patten, Jr. | H01R 4/5025<br>439/428 |
| 8,500,497 | B1 * | 8/2013 | Patten | H01R 4/5091<br>439/784 |

* cited by examiner

Fig. 1
PRIOR ART
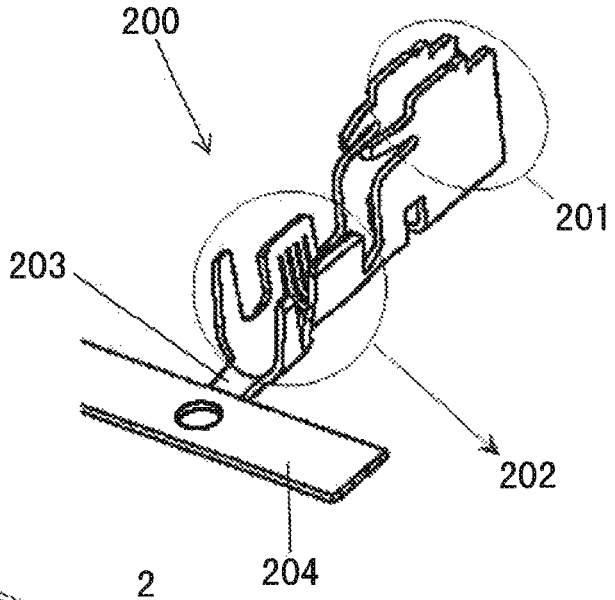
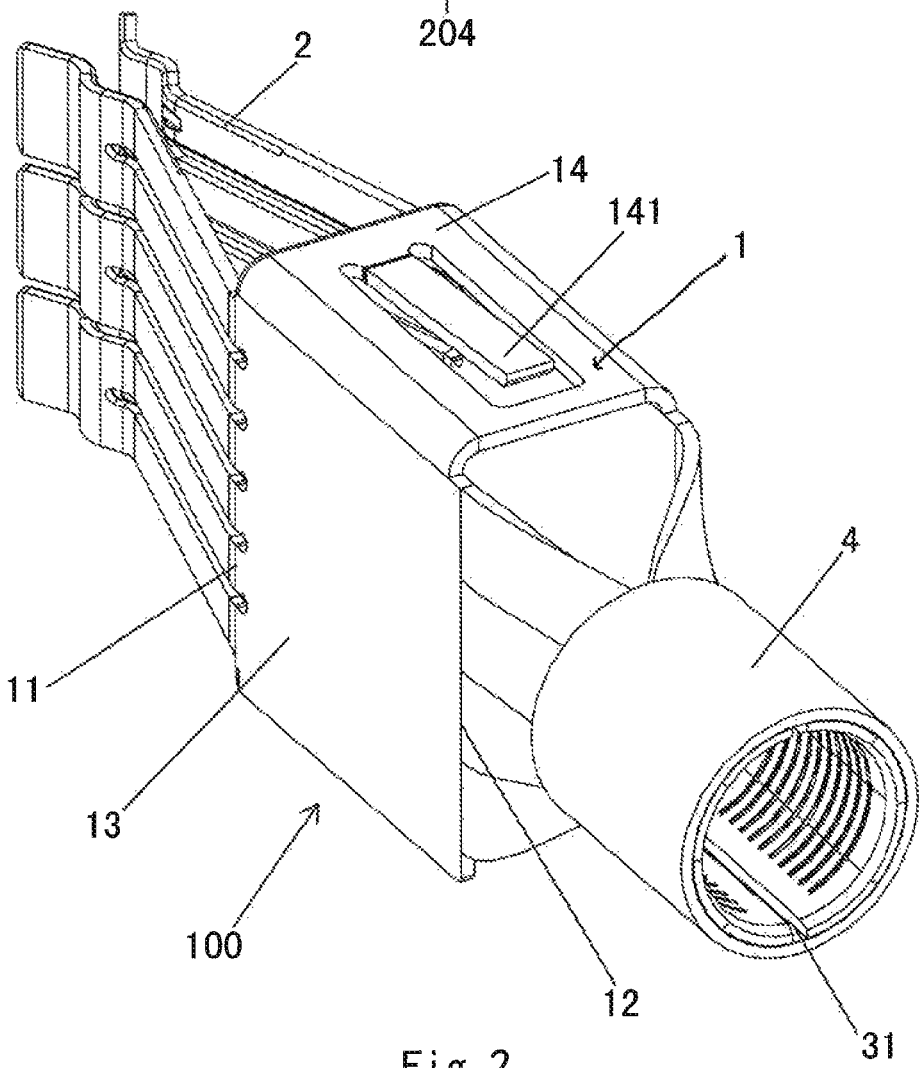
Fig. 2

CONNECTION TERMINAL AND ELECTRICAL CONNECTOR

CROSS-REFERENCE TO RELATED APPLICATION

This application claims the benefit of the filing date under 35 U.S.C. §119 (a)-(d) of Chinese Patent Application No. 201420355846.2 filed on Jun. 30, 2014.

FIELD OF THE INVENTION

The invention relates to a connection terminal, and, more particularly, to an electrical connector having the connection terminal.

BACKGROUND

In order to supply electrical power to electronic devices, a power supply wire is connected to a power supply terminal of the electronic devices. As shown in FIG. 1, a conventional connection terminal 200 has a wire insulation receiving region 201 for crimping an insulating layer of a cable (not shown), a substantially "F" shaped conductor receiving region 202 for crimping a conductor wire of the cable, and a contacting region 203 to be connected to the wiring terminal 204 of the electronic device.

The conductor receiving region 202 is electrically connected to the conductor of the cable by crimping or clamping the region 202 around the conductor. Due manufacture, a transition region between the conductor receiving region 202 and the contacting region 203 is made of metal sheet, and is relatively narrow, limiting the level of transmission power that can be applied.

SUMMARY

A connection terminal has a connector body having a mating end and an opposite cable receiving end; a pair of contact arms extending from the mating end; and a cable receiving member having an approximate cylindrical shape with a variable diameter, and extending from the cable receiving end.

BRIEF DESCRIPTION OF THE DRAWINGS

The invention will be described by way of example, with reference to the accompanying drawings, of which:

FIG. 1 is a perspective view of a conventional connection terminal;

FIG. 2 is a perspective view of a connection terminal having with a sleeve;

DETAILED DESCRIPTION OF THE EMBODIMENT(S)

Figure 3:
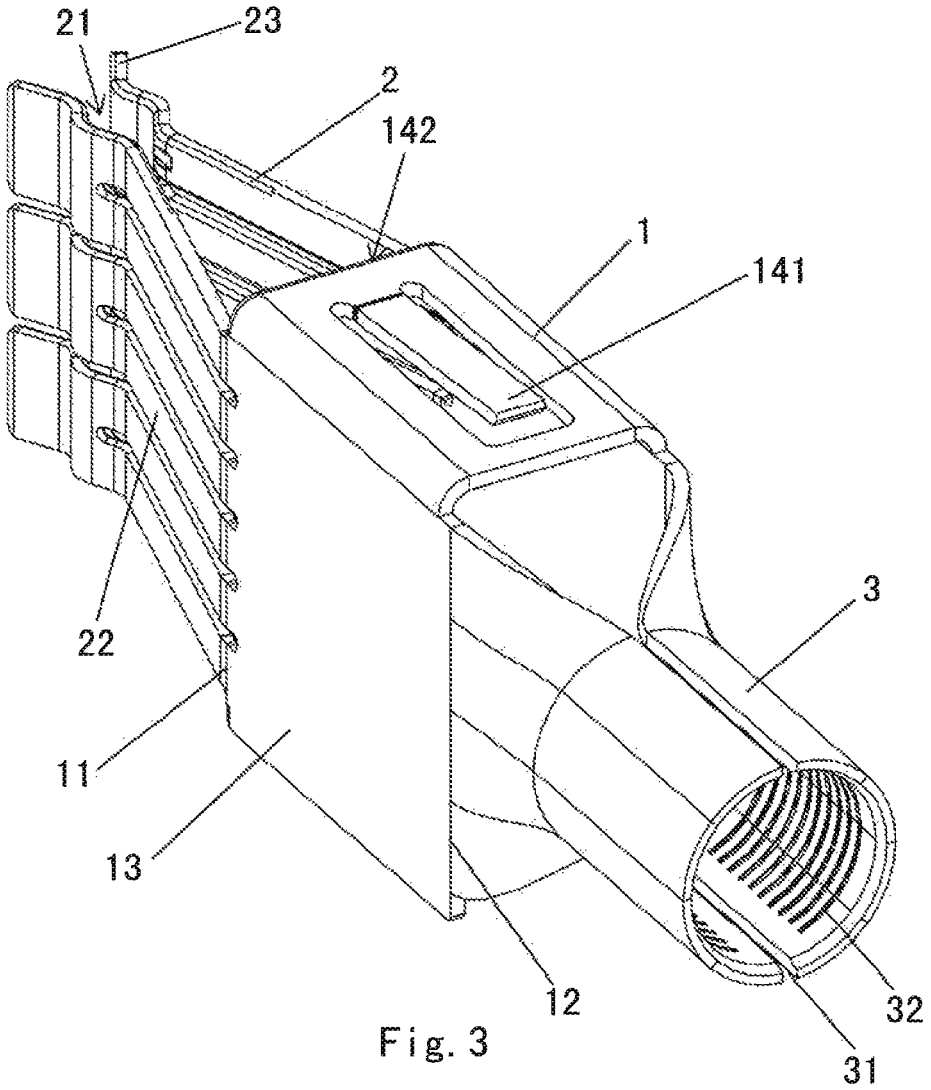
FIG. 3 is a perspective view of the connection terminal in FIG. 2, with the sleeve removed.
Figure 4:
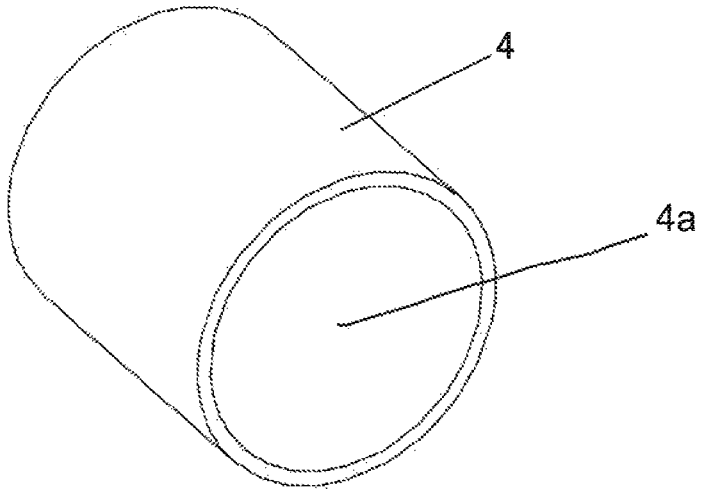
FIG. 4 is a perspective view of the sleeve.

The invention will be described hereinafter in detail with reference to embodiments. The embodiments are meant to be exemplary, and a one of ordinary skill in the art would appreciate that modifications can be made within the scope of the invention. Thus, the following description is a broad teaching for those of ordinary skill in the art and the content thereof is not intended to limit the invention to the embodiments set forth herein.

In the following detailed description, for purposes of explanation, numerous specific details are set forth in order to provide a thorough understanding of the disclosed embodiments. Those of ordinary skill in the art would appreciate that one or more embodiments may be practiced without these specific details. In other instances, well-known structures and devices are schematically shown in order to simplify the drawing.

In the embodiments shown in FIGS. 2-4, 7, and 8, a connection terminal 100 connects a cable 20 with a wiring terminal 400 of an electronic device (not shown), so as to provide a large current signal, such as a power supply signal, to the electronic device via the cable 20. The connection terminal 100 has a connector body 1 made of a single metal sheet such as copper, a pair of contact arms 2 extending from a mating end 11 of the base 1, and a cable receiving member 3 positioned on an opposite cable receiving end 12 of the base 1. In an embodiment, the cable receiving member 3 has a substantially cylindrical shape, although in other embodiments, the cable receiving member 3 may have other shapes.

The pair of contact arms 2 extends from the mating end 11 of the connector body 1, so as to clamp the wire terminal 400 (see FIGS. 7 and 8) of the electronic device. The cable receiving member 3 extends from the cable receiving end 12 of the connector body 1 and has a variable diameter so as to mechanically fix and electrically connect the cable 20 having different diameters (see FIGS. 7 and 8).

In an embodiment, the cable receiving member 3 has a clamping slot 31 extending in a longitudinal direction. In this way, the diameter of the cable receiving member 3 of cylinder shape is changed by the compression and expansion of the clamping slot 31, so as to apply a clamping force to cables 20 having different diameters. In an embodiment, the cable receiving member 3 has two or more clamping slots 31.

The connection terminal 100 has a compressible sleeve 4, which is radially compressible and mounted on the cable receiving member 3. In an embodiment shown in FIG. 4, the sleeve 4 has a centrally positioned receiving space 4*a*. In an embodiment, the sleeve 4 is made of rubber material. When the cable 20 is connected to the cable receiving member 3, an outer insulating layer of the cable is firstly peeled off so as to expose a conductor of the cable 20; then the cable 20 is positioned into the receiving space 4*a* of the sleeve 4. The conductor of the cable 20 is then inserted into the cable receiving member 3. Next, the sleeve 4 is mounted on the cable receiving member 3, with the cable receiving member 3 being positioned in the receiving space 4*a*. The sleeve 4 exerts an inward compressive force, so as to press tightly against the cable receiving member 3, fasten the conductor of the cable 20 within the cable receiving member 3 and achieve the electrically connection between the conductor and the cable receiving member.

As shown in the embodiment of FIG. 3, two opposing clamping slots 31 extend longitudinally along the cable receiving member 3 to split the cable receiving member 3 into two semi-circle recessed structures, which extend from a first wall and an opposite second wall at the cable receiving end 12 of the connector body 1, respectively. The two semi-circle recessed structures are formed by bending a sheet metal. The clamping slots 31 are positioned at the abutting interface of the two semi-circle recessed structures.

An inner surface of the cable receiving member 3 has a plurality of grooves 32 so as to increase the friction force between the inner surface of the cable receiving member 3 and the conductor.

Figure 6:
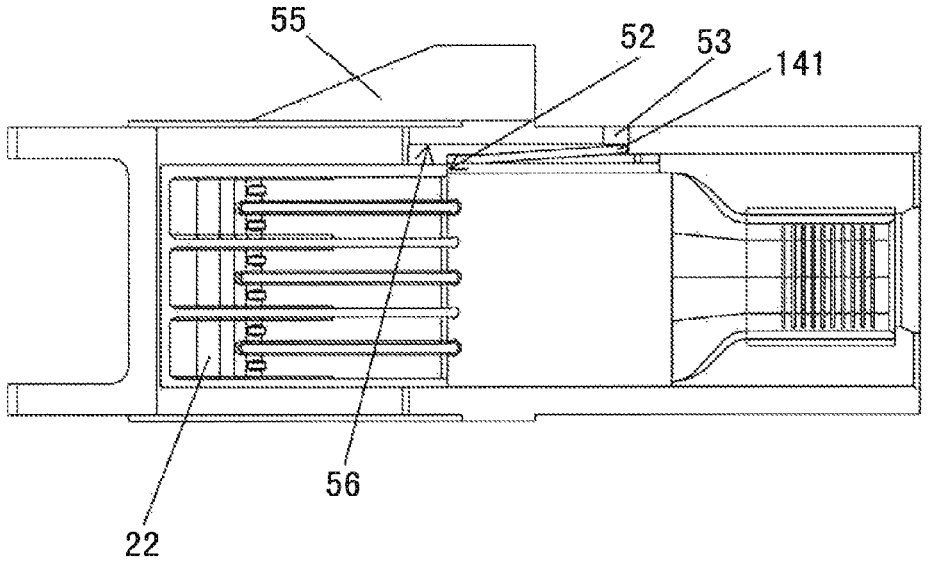
FIG. 6 is a cross-sectional view of the electrical connector along an axis A shown in FIG. 5.

In an embodiment shown in FIG. 6, the connector body 1 has a cross section of substantially "U" shape or substantially rectangle shape. The connector body 1 and includes a first wall 13, a second wall (not labeled) opposite to the first wall, and a third wall 14 connected to the first wall 13 and the second wall and extending therebetween. The pair of contact arms 2 extends from the first wall 13 and the second wall at the mating end 11 of the connector body 1, and, after bending to facing one another, forms a terminal receiving space 21 therebetween, into which the wiring terminal of the electronic device is inserted. Each of the contact arms 2 has a plurality of resilient regions 22 so as to increase flexibility of the contact arms 2. As shown in FIG. 3, the mating end of the third wall 14 is provided with a first stepped portion 142.

Further, the third wall 14 has a cantilevered latching arm 141 projecting outwards.

Free ends 23 of the pair of cantilevered contact arms 2 inclinedly extend outwards so as to be positioned away from each other.

Figure 5:
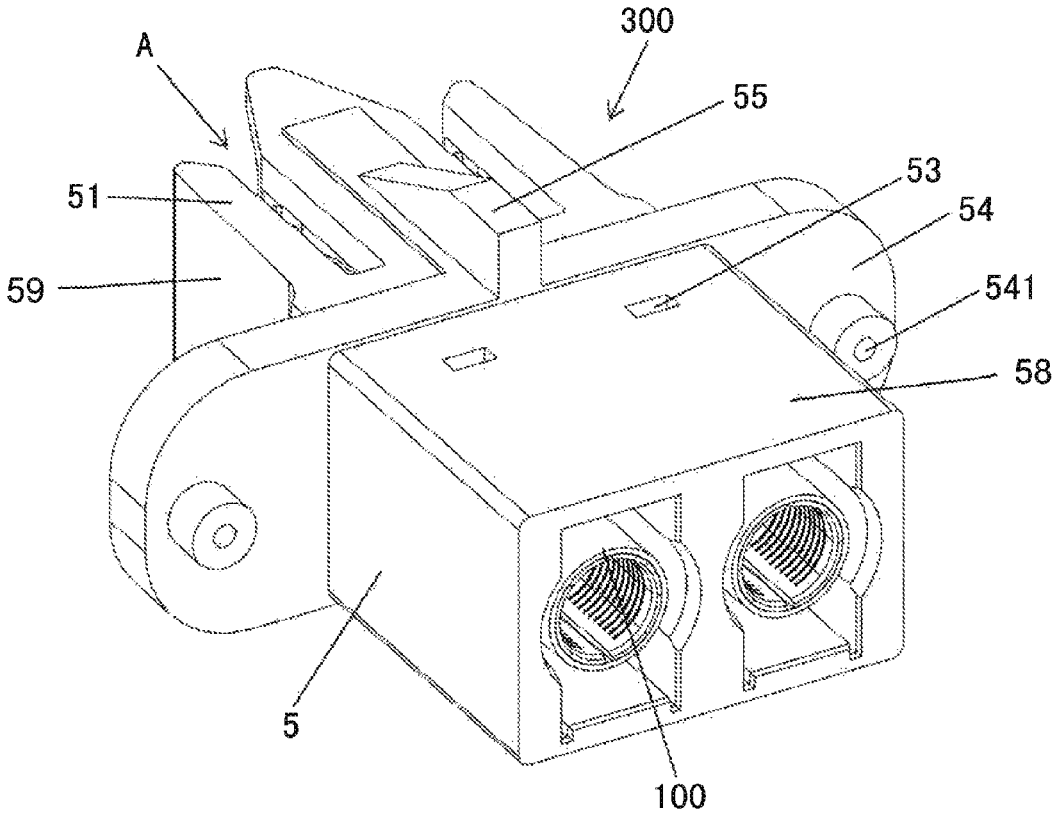
FIG. 5 is a perspective view of an electrical connector with the connection terminal.

In an embodiment shown in FIG. 5, an electrical connector 300 for connecting the cable 20 with the wiring terminal 400 of the electronic device, has one or more connection terminals 100, and a connector housing 5 made of insulating material such as plastic or resin, in which the connection terminal 100 is positioned.

The connector housing 5 has a connector body receiving member 57 on a cable receiving end and a contact arm receiving member 58 on an opposite mating end. The connector body 1 and the cable receiving member 3 of the connection terminal 100 are mounted within the connector body receiving member 57. Each pair of contact arms 2 is mounted within the contact arm receiving member 58.

The contact arm receiving member 58 has a plurality of pairs of vertical walls 51, and two vertical walls of each pair of vertical walls 51 are separated from each other. Two arms of a pair of first contact arms 2 of the connection terminal 100 abut against the respective walls of a pair of vertical walls 51, and the free ends 23 of the pair of contact arms 2 inclinedly extend outwards in opposite directions so as to be positioned away from each other, such that the pair of contact arms 2 can elastically clamp a wiring terminal 400. Those of ordinary skill in the art would appreciate that a distance between each pair of vertical walls 51 is set to elastically bias the free ends 23 of each pair of contact arms, such that the wiring terminal 400 with flat-surface structure may be inserted into the terminal receiving space 21 between the pair of contact arms 2. The wiring terminal 400 is thus elastically pressed so as to maintain a reliable electrical connection between the contact arms 2 and the wiring terminal 400.

As shown in an embodiment of FIG. 6, a second stepped portion 52 is positioned within the connector body receiving member 57. When the connection terminal 100 is mounted within the connector housing 5, the first stepped portion 142 of the connector body 1 (at the front end of the third wall 14) abuts against the second stepped portion 52 so as to prevent the connection terminal 100 from moving in the insertion direction in which the connection terminal 100 is inserted into the connector housing 5 (a direction from right to left in FIG. 6). In addition, the latching arm 141 is positioned on the third wall 14, and the inner surface of the connector body receiving member 57 has a corresponding latching arm receiving recess 56 for partially receiving the latching arm 141, so as to prevent the connection terminal 100 from moving in the direction opposite to the insertion direction. In this way, the connection terminal 100 is retained in the connector housing 5 by cooperation of the first stepped portion 142 and the second stepped portion 52, as well as cooperation between the latching arm 141 and the latching arm receiving recess 56.

Further, one or more through-holes 53 are disposed on the connector body receiving member 57, with each of the through-holes 53 extending from the latching arm receiving recess 56 to an outside of the connector housing 5 in the direction perpendicular to the insertion direction (up-down direction in FIG. 6). To remove the connection terminal 100 from the connector housing 5, a tool (not shown), such as a screw-driver, can be inserted into the through-hole 53 to press the latching arm 141. The tool disengages the latching arm 141 from the latching arm receiving recess 56, permitting the connection terminal 100 to be removed from the connector housing 5 from the right side of FIG. 6.

Figure 7:
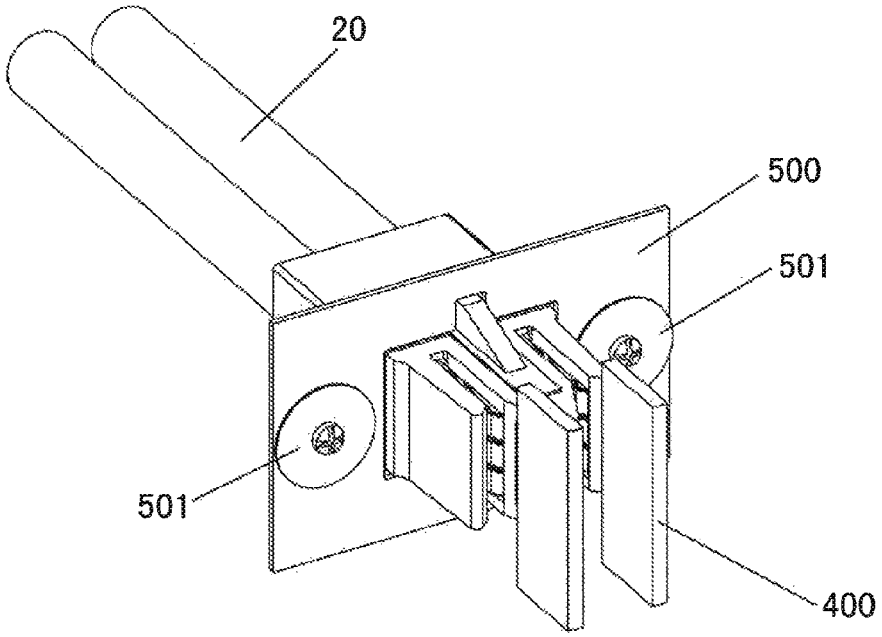
FIG. 7 is a perspective view of a mating end of the electrical connector with attached cables and a complimentary mating connector.
Figure 8:
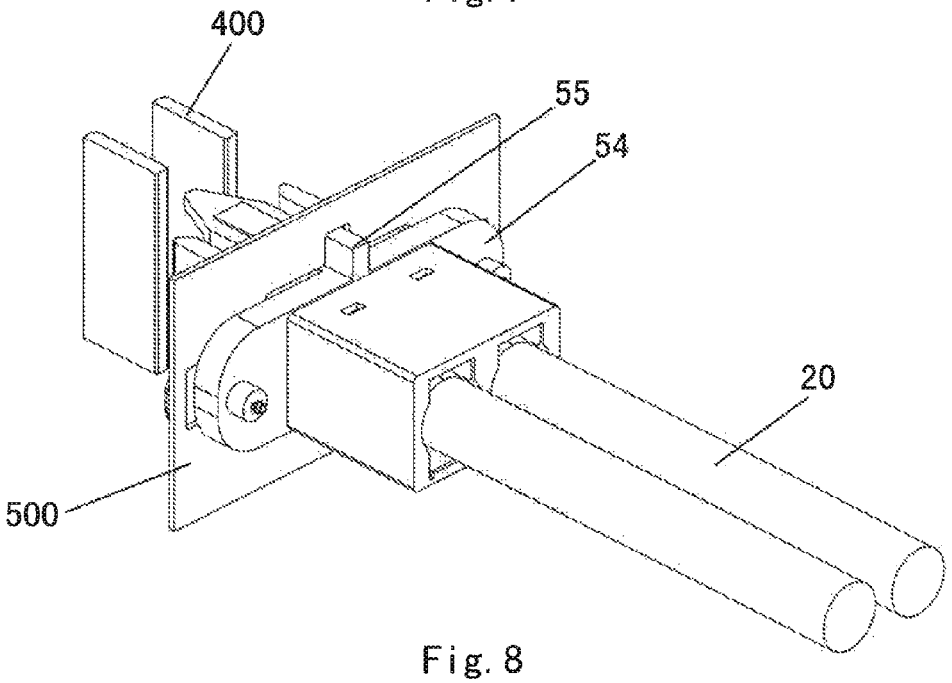
FIG. 8 is a perspective view of a terminating end of the electrical connector in FIG. 7.

In the embodiments shown in FIGS. 5, 7, and 8, a pair of connecting flanges 54 are positioned on the connector housing 5 in a region whereby the connector body receiving member 57 and the contact arm receiving member 58 interface. The pair of connecting flanges 54 projecting outwards in opposite directions approximately perpendicular to a longitudinal axis of the connector housing 5. The electrical connector 300 is mounted onto a bracket 500, such as a support plate, through the connecting flanges 54. In an embodiment, the connecting flanges 54 each have a fastener receiving hole 541, which may optionally have a threaded inner surface. The electrical connector 300 is mounted onto the bracket 500 by screwing screws 501 into the respective fastener receiving holes 541 from an opposite side of the bracket 500 than a side on which the connecting flanges 54 are positioned.

In an embodiment, the connector housing 5 is has a guiding key 55, and the bracket 500 has a corresponding guiding groove (not labeled). When the electrical connector 300 is installed, the guiding key 55 is be aligned with the guiding groove, thus preventing the electrical connector from being incorrectly inserted into the bracket.

By using the connection terminal and the electrical connector according to the embodiments described above, an electrical signal having a large current, such as the current signal for transmitting larger power, or other type of driving signal, may be transmitted. The electrical connector is provided with two pairs of contact arms, which respectively can act as a positive connection terminal and a negative connection terminal for the electrical signal, so as to provide power supply signal to the electronic device. The electrical connector can also be provided with only one pair of contact arms so as to transmit one kind of current signal. In addition, the electrical connector can be provided with multiple pairs of contact arms so as to transmit different kinds of current signals.

Since the cable receiving member for connecting with the conductor of the cable has a variable diameter, conductors with different diameters may be inserted into the cable receiving member. Since the cable receiving member comes into contact with approximately a large outer surface area of the conductor, the ability of the connection terminal for transmitting large current signal is improved. In addition, the conductor is securely retained within the cable receiving member with an elastically shrinkable and compressible sleeve so as to ensure the reliable electrical connection between the cable receiving member and the conductor.

Those of ordinary skill in the art would appreciate that the above embodiments are intended to be exemplary. Many modifications can be made to the above embodiments by those skilled in the art, and various structures described in the various embodiments may be freely combined with each other without conflicting in configuration or principle. Thus, many additional connection terminal and electrical connector embodiments can be made from different combinations of the above described technical features.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A connection terminal, comprising:

a connector body having a mating end and an opposite cable receiving end, the connector body formed as a substantially rectangular shaped cross-section with a first wall, a second wall positioned opposite to the first wall, and a third wall connected to the first wall and the second wall and extending therebetween;

a pair of contact arms extending from the mating end; and a cable receiving member having an approximate cylindrical shape with a variable diameter, the cable receiving member split into two bent semi-circular recessed structures that extend from the first wall and the second wall at the cable receiving end.

2. The connection terminal of claim 1, further comprising a clamping slot extending in an axial direction and positioned on the cable receiving member.

3. The connection terminal of claim 1, further comprising a radially shrinkable compression sleeve mounted on the cable receiving member.

4. The connection terminal of claim 1, wherein the pair of contact arms extends from the first wall and the second wall at the mating end, each contact arm being bent toward each other, and having a terminal receiving space positioned between the pair of contact arms.

5. The connection terminal of claim 1, wherein an inner surface of each recessed structure has a plurality of grooves.

6. The connection terminal of claim 1, wherein, each of the contact arms comprises a plurality of resilient regions.

7. The connection terminal of claim 1, wherein a latching arm is positioned on the third wall.

8. The connection terminal of claim 4, wherein free ends of the pair of contact arms are bent outwardly away from each other.

9. An electrical connector, comprising:

a connector housing; and one or more connection terminals positioned in the connector housing, and having:

a connector body having a mating end and an opposite cable receiving end, the connector body formed as a substantially rectangular shaped cross-section with a first wall, a second wall positioned opposite to the first wall, and a third wall connected to the first wall and the second wall and extending therebetween;

a pair of contact arms extending from the mating end; and a cable receiving member having an approximate cylindrical shape with a variable diameter, the cable receiving member split into two bent semi-circular recessed structures that extend from the first wall and the second wall at the cable receiving end.

10. The electrical connector of claim 9, wherein the connector housing has:

a connector body receiving member into which the connector body and the cable receiving member is positioned; and a contact arm receiving member into which the contact arms are positioned.

11. The electrical connector of claim 10, wherein the contact arm receiving member includes a plurality of pairs of vertical walls.

12. The electrical connector of claim 11, wherein two arms of the pair of first contact arms abut respective walls of a pair of the vertical walls.

13. The electrical connector of claim 9, wherein the connector body has a first stepped portion.

14. The electrical connector of claim 13, wherein the connector body receiving member has a second stepped portion that abuts the first stepped portion when the connection terminal is inserted into the connector housing.

15. The electrical connector of claim 9, wherein a latching arm is positioned on the third wall and the connector body receiving member has a latching arm receiving recess positioned on an inner surface.

16. The electrical connector of claim 15, wherein one or more through-holes are disposed on the connector body receiving member, each of the through-holes extending through the connector body receiving member from the latching arm receiving recess to outside of the connector housing in a direction perpendicular to a connection terminal insertion direction.

17. The electrical connector of claim 9, wherein the connector housing has a pair of connecting flanges projecting outwards in opposite directions approximately perpendicular to a connection terminal insertion direction.

18. The electrical connector of claim 9, wherein the connector housing has a bracket guiding key.

* * * * *